US007886671B2

(12) United States Patent
Roberge et al.

(10) Patent No.: US 7,886,671 B2
(45) Date of Patent: Feb. 15, 2011

(54) HEIGHT ADJUSTABLE WORKSTATION

(75) Inventors: James Roberge, Westford, MA (US); Jason Rathbone, Amesbury, MA (US)

(73) Assignee: Raytheon Company, Waltham, MA (US)

( * ) Notice: Subject to any disclaimer, the term of this patent is extended or adjusted under 35 U.S.C. 154(b) by 336 days.

(21) Appl. No.: 12/070,628

(22) Filed: Feb. 20, 2008

(65) Prior Publication Data

US 2009/0206047 A1 Aug. 20, 2009

(51) Int. Cl.
*A47B 37/00* (2006.01)

(52) U.S. Cl. ..... 108/50.01; 312/223.3; 312/319.4; 108/6

(58) Field of Classification Search ..... 312/223.3, 312/319.4, 223.1; 108/50.01, 50.02, 2, 6–10; 248/917, 919–922
See application file for complete search history.

(56) References Cited

U.S. PATENT DOCUMENTS 4,920,458 A * 4/1990 Jones ..... 362/33
5,174,223 A * 12/1992 Nagy et al. ..... 108/50.01
5,980,004 A * 11/1999 Shoenfeld ..... 312/223.3
6,042,203 A * 3/2000 Bogucki ..... 312/223.3
6,286,794 B1 * 9/2001 Harbin ..... 248/123.2
6,394,402 B2 * 5/2002 Coonan et al. ..... 248/123.11
6,536,356 B2 * 3/2003 Krieger et al. ..... 108/50.01
6,550,724 B2 * 4/2003 Gosling ..... 248/125.2
6,712,008 B1 * 3/2004 Habenicht et al. ..... 108/96
2004/0254020 A1 * 12/2004 Dragusin ..... 463/46
2005/0094361 A1 * 5/2005 Lee ..... 361/681
2006/0238967 A1 * 10/2006 Carson et al. ..... 361/681

* cited by examiner

*Primary Examiner*—Hanh V Tran
(74) *Attorney, Agent, or Firm*—Iandiorio Teska & Coleman

(57) ABSTRACT

A height adjustable workstation comprising a frame, a console supported by and movable up and down with the respect to the frame, and a keyboard tray supported by the console and pivotable with respect thereto when the console is moved down.

15 Claims, 12 Drawing Sheets

FIG. 12
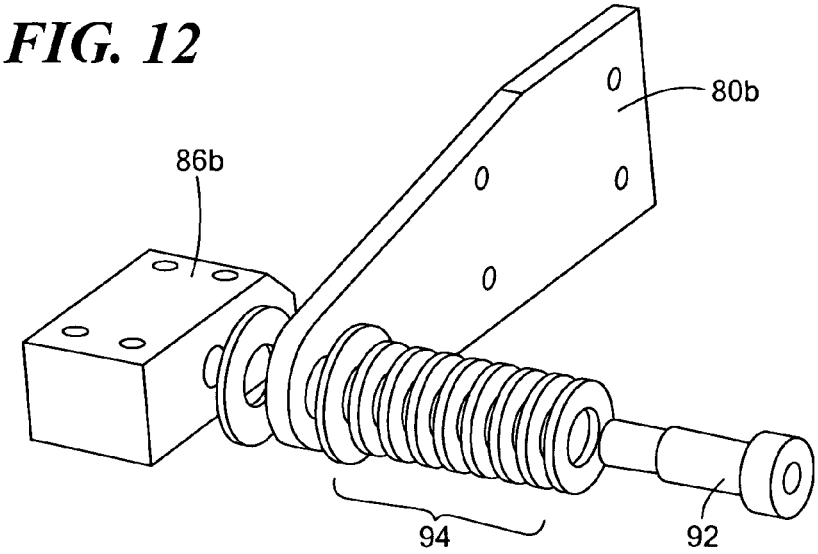
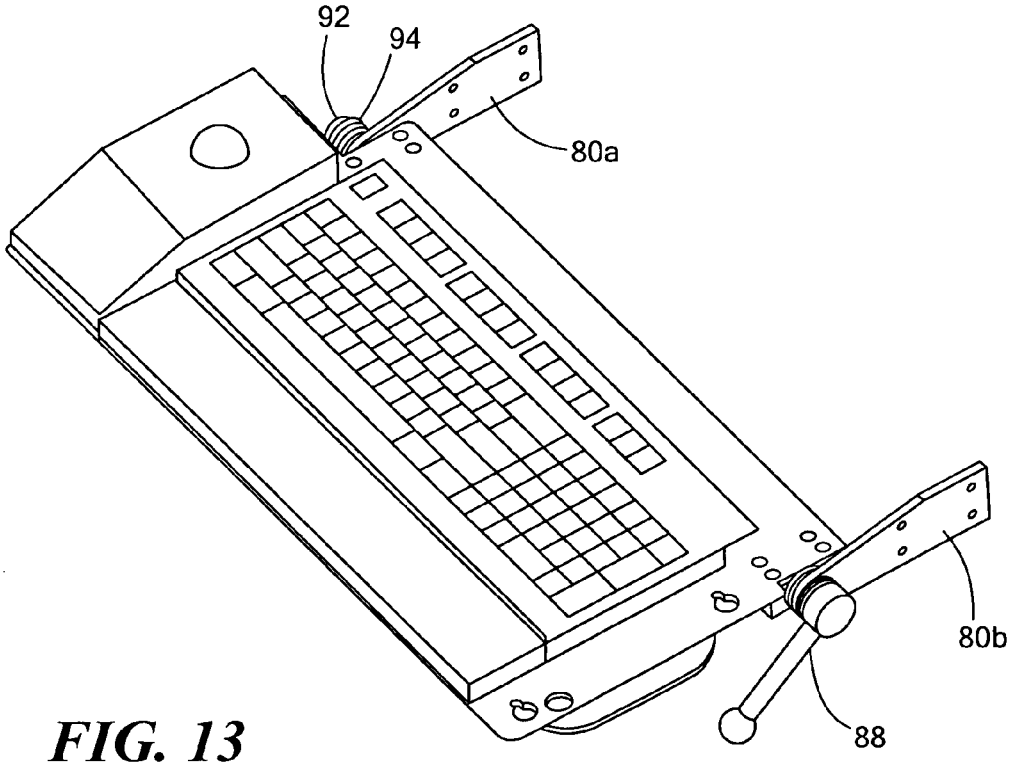
FIG. 13

HEIGHT ADJUSTABLE WORKSTATION

GOVERNMENT RIGHTS

This invention was made with U.S. Government support under Contract No. W31P4Q-04-C-0020 by the U.S. Army. The Government has certain rights in the subject invention.

FIELD OF THE INVENTION

This subject invention relates to a height adjustable workstation useful, inter alia, in height reducible electronics enclosures.

BACKGROUND OF THE INVENTION

Modern mobile battlefield electronics enclosures are reconfigurable to support, for example, different missions. One electronics enclosure is height reducible so that it can be loaded into and carried by a cargo plane (e.g., a C130 cargo plane). When deployed, the shelter is 85 inches high and when stowed is 45 inches high.

Workstations are required in the enclosure each typically including one or more displays, a keyboard, and processing electronics.

It is desirable that the workstations are height reducible in order to stow the enclosure for transport. For tactical reasons, the workstation must quickly and easily deploy and collapse. Other requirements for such a workstation includes an ergonomic and rugged design, a height adjustable display, a small footprint, and shock isolation.

No commercially available product meet these requirements.

BRIEF SUMMARY OF THE INVENTION

It is therefore an object of this invention to provide a height adjustable workstation.

It is a further object of this invention to provide such a workstation which can accommodate dual touch panel displays.

It is a further object of this invention to provide such a workstation which is adjustable to accommodate a $5^{th}$ to $95^{th}$ percentile operator.

It is a further object of this invention to provide such a workstation which is ergonomic in design.

It is a further object of this invention to provide such a workstation which is quickly and easily deployable and stowable.

It is a further object of this invention to provide such a workstation which has a small footprint and is modular.

It is a further object of this invention to provide such a workstation which is rugged in design and provides shock isolation.

The subject invention results from the realization that a workstation with a console supported by and movable up and down with respect to a frame in a controlled manner allows quick and easy deployment of the workstation for use by an operator and quick and easy stowage.

The subject invention features a height adjustable workstation comprising a frame, a console supported by and movable up and down with the respect to the frame, and a keyboard tray supported by the console and pivotable with respect thereto when the console is moved down.

In the preferred embodiment, the console includes a first monitor rack and a second monitor rack angled outwardly over the first monitor rack. Typically, at least one spring is mounted to the frame and secured to the console and biased to drive the console up. In one example, the spring is a constant force spring.

The frame may include two spaced rails and the console then includes bearings which ride on the rails. Further included is a latch for releasably locking the console in a stowed position.

Preferably, an adjustable friction hinge assembly is located between the keyboard tray and the console. In one example, the adjustable friction hinge assembly includes a first ear coupled to one side of the console, a first bracket coupled to one side of the tray, and a handle with a shaft extending through the first ear and into the first bracket. A second ear is coupled to an opposite side of the console, a second bracket is coupled to an opposite side of the tray, and a fastener extends through several belleville washers and the second ear and into the second bracket.

The subject invention also features a height adjustable workstation including a frame including spaced rails, a console including friction bearings which ride on the rails for moving the console up into a deployed position and down to a stowed position with respect to the frame, a keyboard tray supported by the console and pivotable with respect thereto when the console is stowed, and spring means for biasing the console into the deployed position.

Preferably, the console, when fitted with one or more monitors, has a weight and the biasing force of the spring means is approximately equal to the weight and the friction force of the friction bearings. Typical spring means includes a pair of constant force springs mounted to the frame and secured to the console.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which:

FIG. 12 is a schematic three-dimensional exploded view showing an example of an adjustable friction hinge assembly for the keyboard tray shown in FIG. 10; and FIG. 13 is a schematic three-dimensional view showing another example of a keyboard tray assembly.

DETAILED DESCRIPTION OF THE INVENTION

Figure 1A:
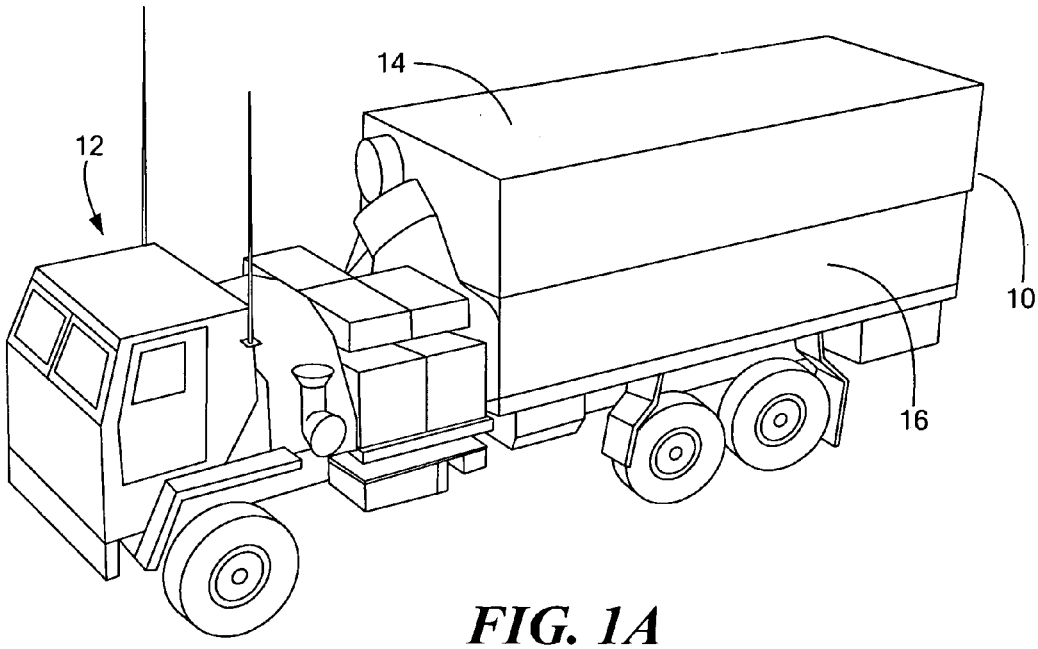
FIG. 1A is a schematic three-dimensional view showing an example of a height reducible electronics enclosure mounted on a vehicle.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 1B:
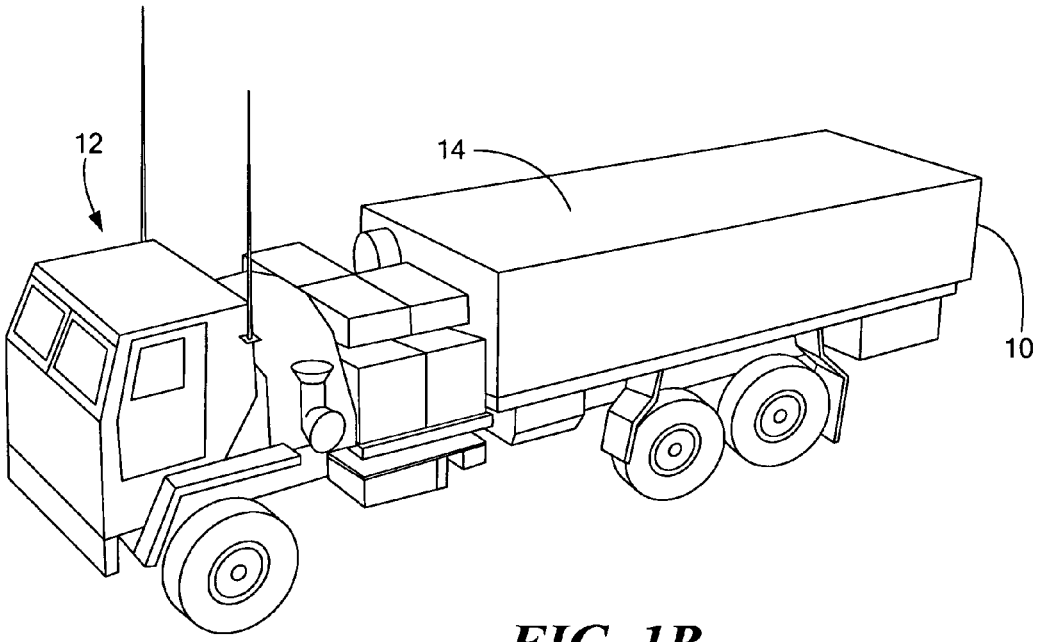
FIG. 1B is a schematic three-dimensional side view showing the enclosure of FIG. 1A in its stowed configuration.

FIG. 1A shows an example of electronics enclosure 10 mounted on the bed of vehicle 12. Electronics enclosure 10 is in its deployed configuration and top portion 14 is extended relative to base portion 16. FIG. 1B shows how top portion 14 is lowered in the stowed position for transport via vehicle 12 and/or when vehicle 12 is itself transported in a cargo plane.

It is desirable to include, within enclosure 10, one or more workstations. But, since enclosure 10 adjust in height, prior art workstations were found to be unsuitable.

Figure 2:
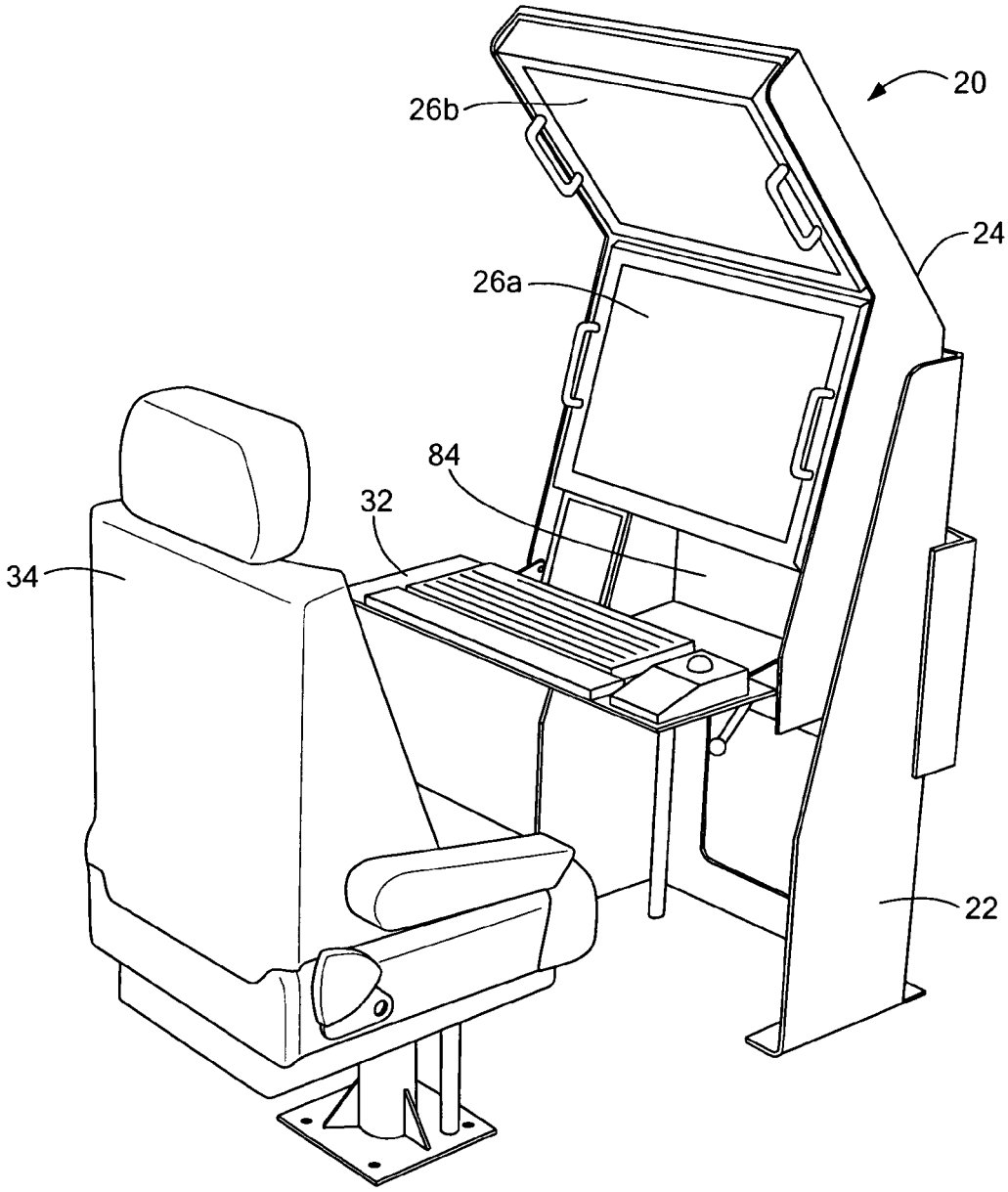
FIG. 2 is a highly schematic three-dimensional front view showing an example of a height adjustable workstation in accordance with the subject invention.
Figure 3:
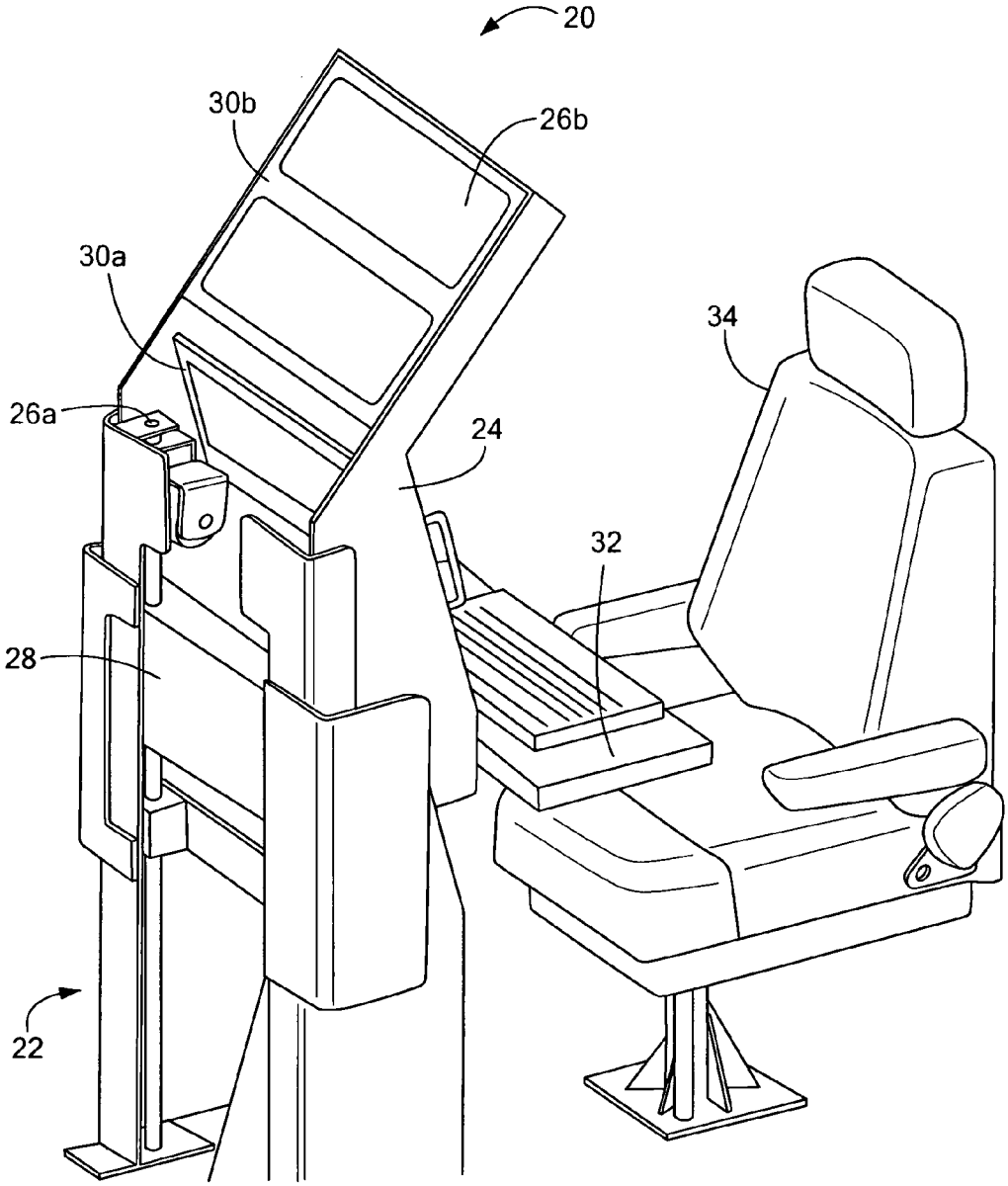
FIG. 3 is a highly schematic three-dimensional rear view of the workstation shown in FIG. 2.

FIG. 2 shows an example of one such workstation in accordance with the subject invention. Workstation 20 includes frame 22 and console 24 supported by and movable up and down with respect to frame 22. Console 24, in this example, supports monitors 26*a* and 26*b* (e.g., 21-inch tough panel displays) and digital processor module 28, FIG. 3. Monitor 26*a* is received in the first monitor rack 30*a* and monitor 26*b* is received in second monitor rack 30*b* angled outwardly over first monitor rack 30*a*. Keyboard tray 32, FIGS. 2 and 3 is supported by console 24 and pivots to suit the user seated in seat 34 and, as shown in FIGS. 4-5, pivotable upwardly when console 24 is moved down into its stowed position so as not to interfere with chair 34.

Figure 4:
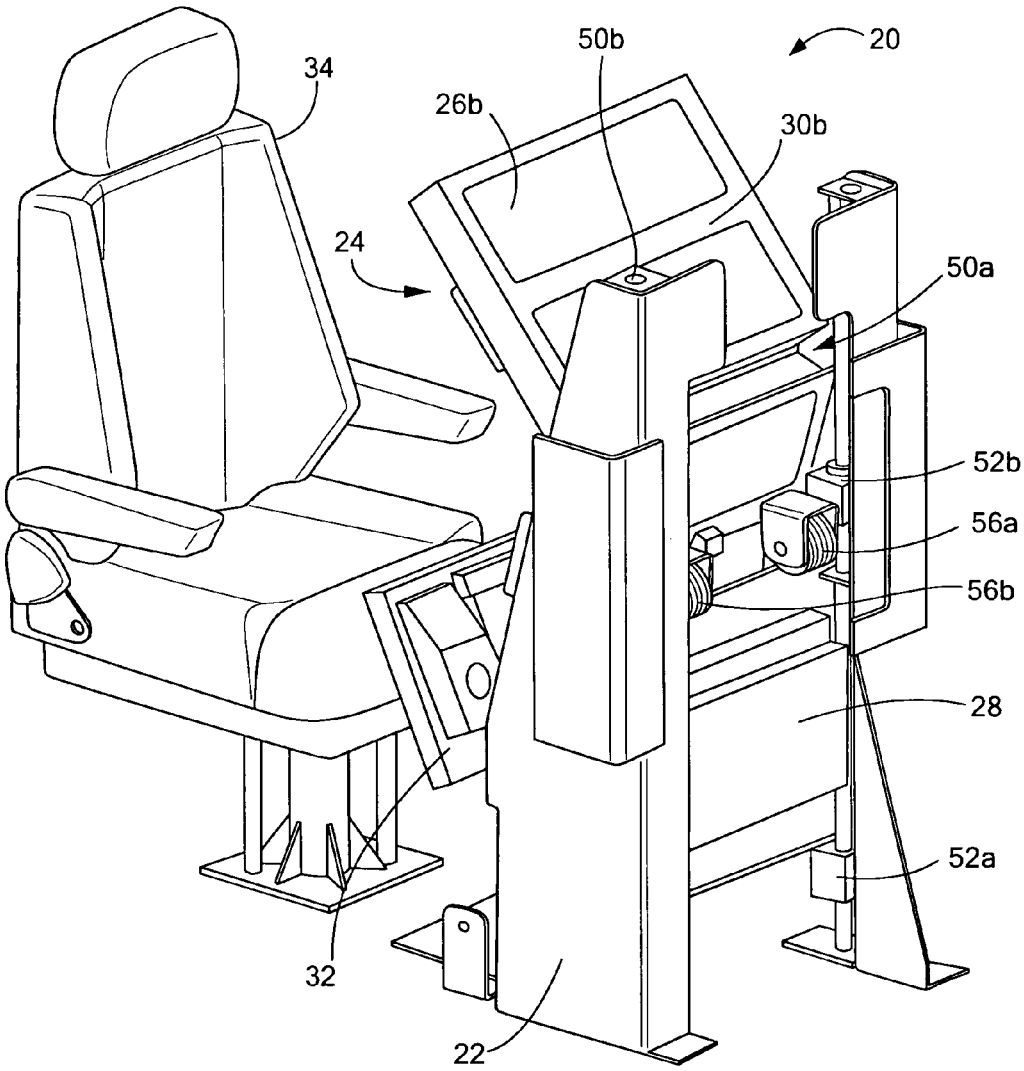
FIG. 4 is another schematic three-dimensional rear view of the workstation shown in FIGS. 2 and 3 showing the workstation in its stowed configuration.

FIG. 4 shows frame side rails 50*a* and 50*b*. Console 24 includes friction bearings 52*a* and 52*b* which ride alongside rail 50*a* and two other spaced friction bearings (not shown in FIG. 4) which ride along rail 50*b*. Constant force springs 56*a* and 56*b* are mounted on frame 22 and are secured to console 24 to drive console 24 up into its deployed position as discussed below. Other spring means for biasing the console in the deployed position are possible.

It is desirable to choose a spring force for springs 56*a* and 56*b* such that, together, they apply a force approximately equal to but just greater than the weight of console 24 when fitted with the two monitors taking into account the friction of the bearings and any other friction associated with the system. In this way, console 24, when in the stowed position and released, slowly rises into the deployed position on its own and can also be returned to the stowed position easily by a slight downward force. The idea in the preferred embodiment is a one-handed operation for stowing and deploying the workstation. In one example, the spring force chosen may provide a near neutral counterbalance to the weight of the console plus the friction of the bearings. Constant force springs are used because they provide a constant force over the distance the console travels.

Figure 5:
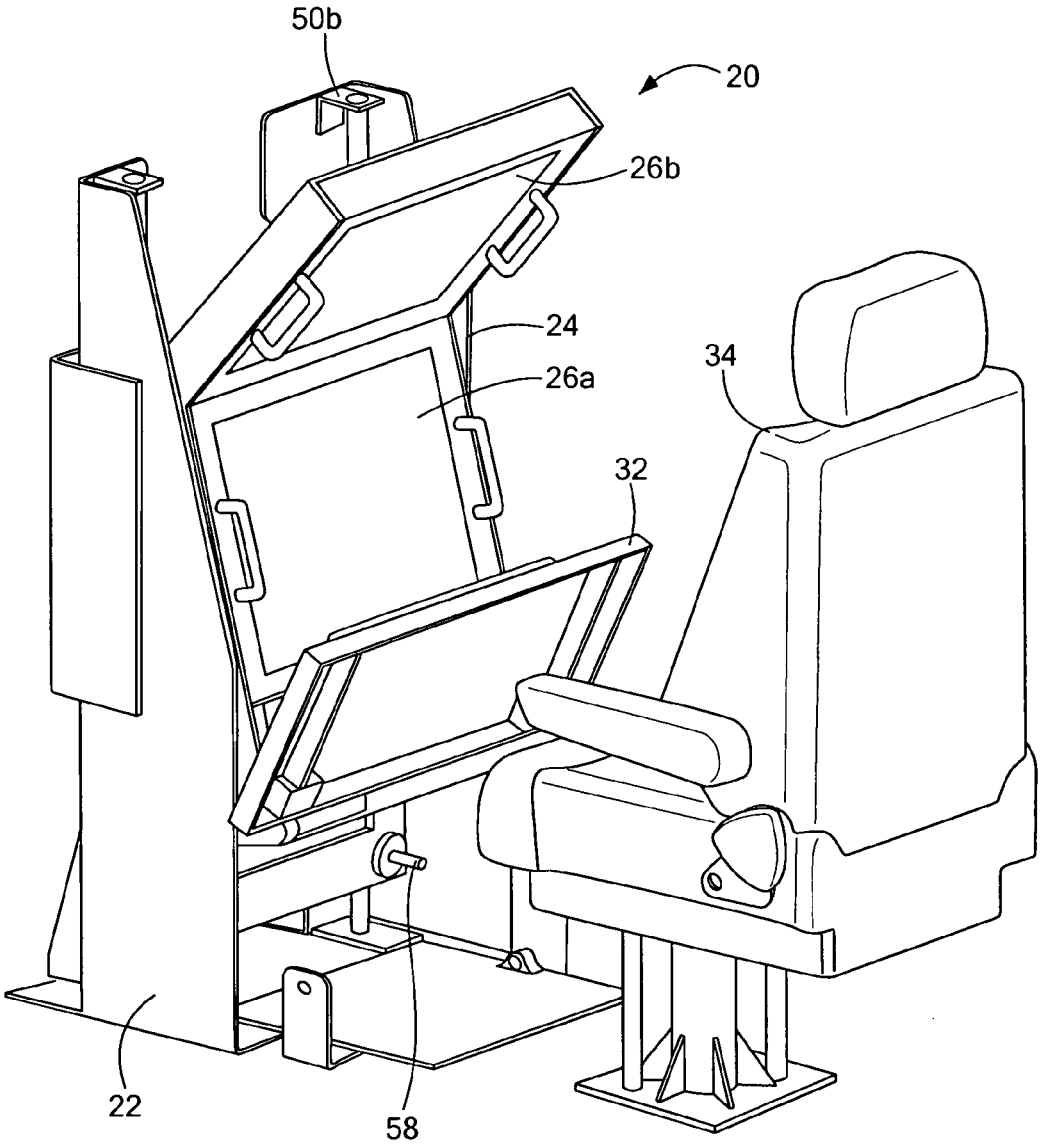
FIG. 5 is a schematic three-dimensional front view showing the workstation in its stowed configuration.

FIG. 5 shows latch 58 which releasably locks console 24 in the stowed position. In the deployed position, the height of the console relative to the frame can be adjusted via fasteners, a latch or pins. Latch 58 is received in one of four holes in rail 50*b*.

Figure 6B:
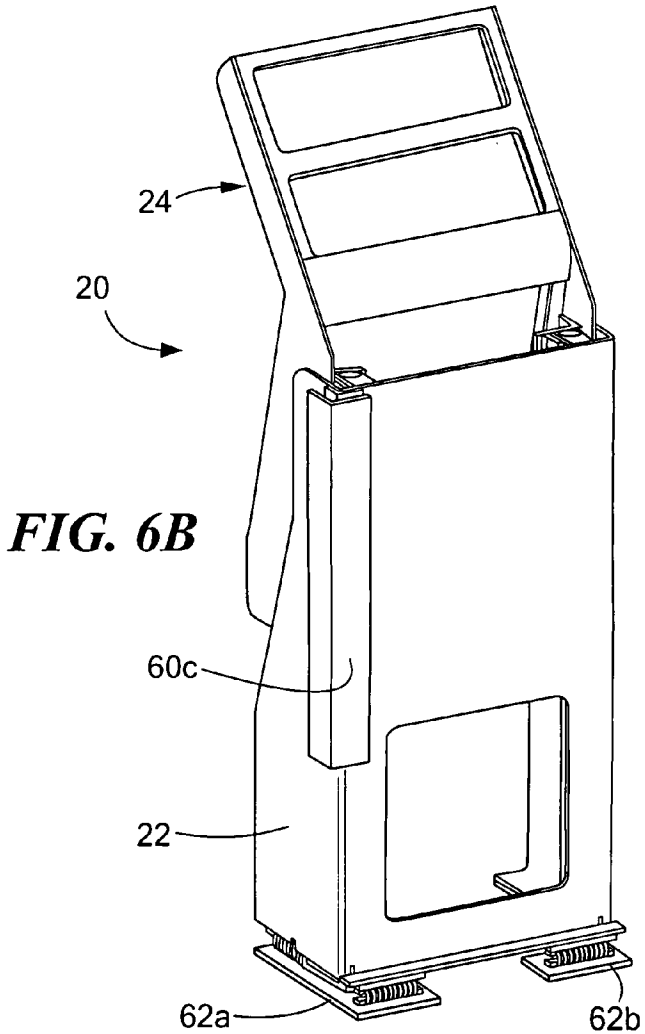
FIGS. 6A-6C are schematic three-dimensional partial views of a workstation in accordance with the subject invention showing several different mount configurations.
Figure 6A:
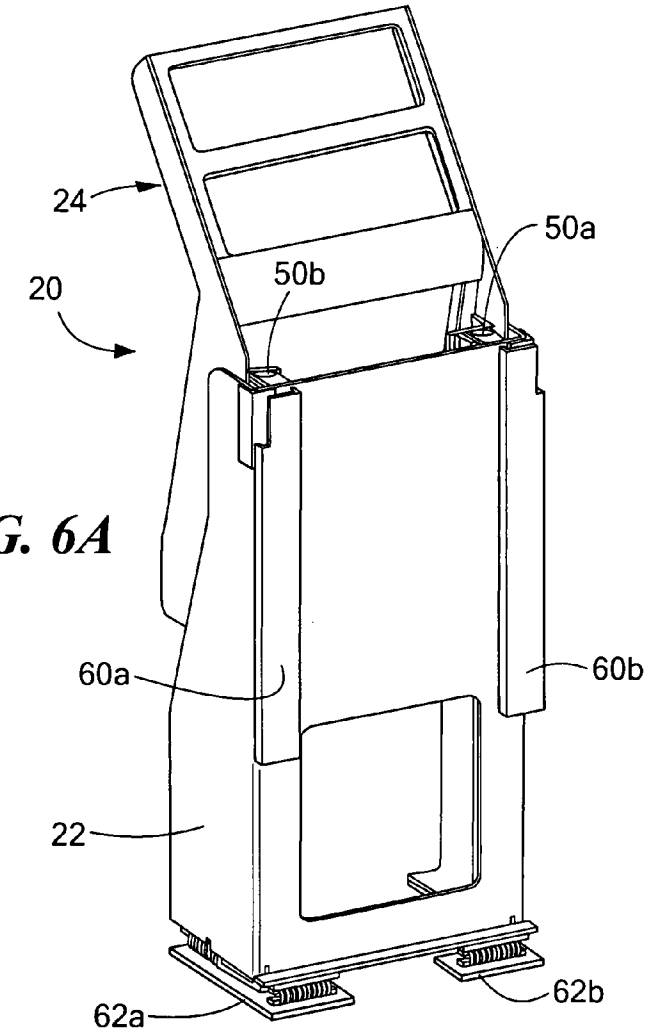
Figure 6C:
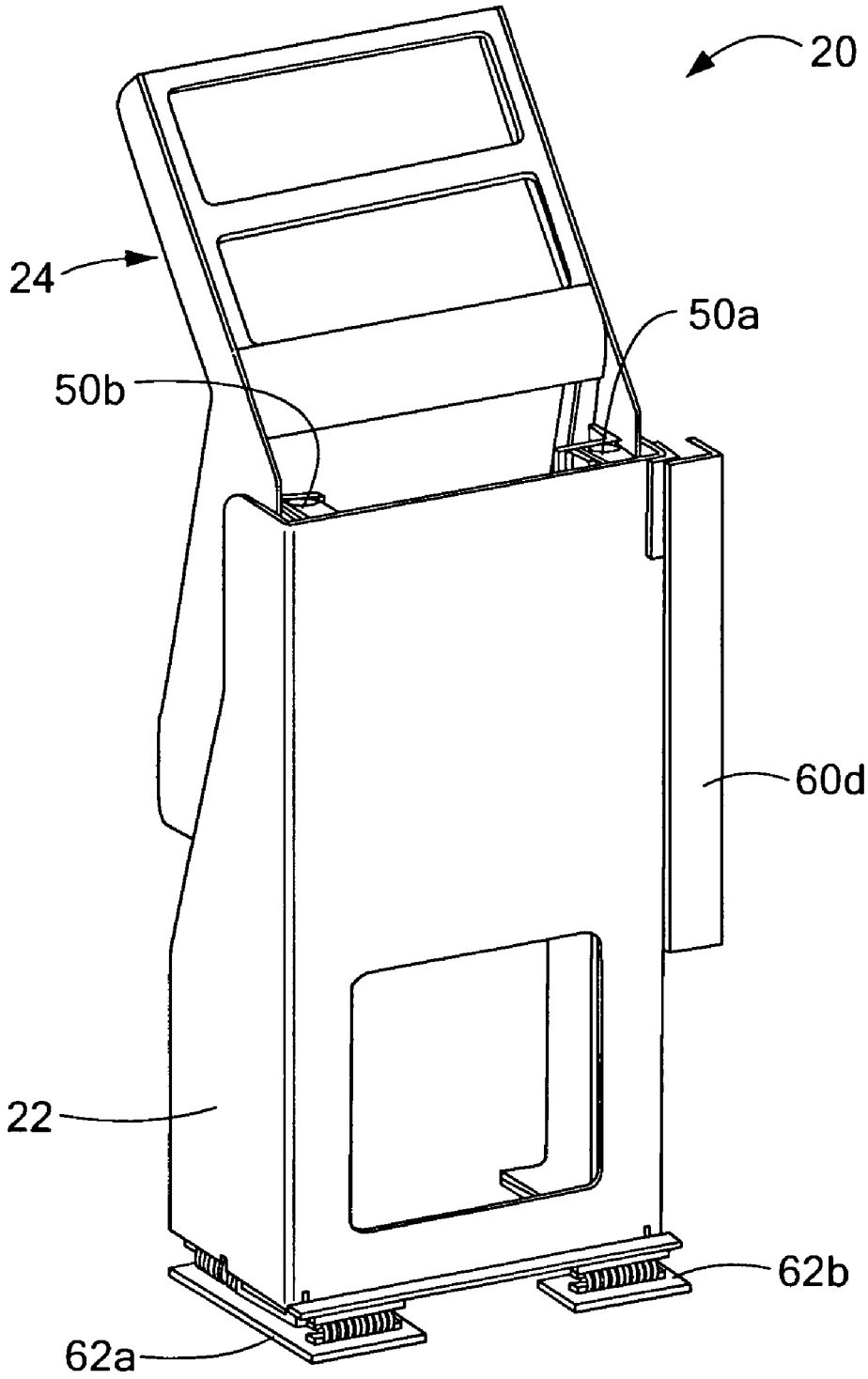

As shown in FIGS. 6A-6B, workstation 20 can be configured so frame 22 mounts to a wall behind the workstation within an enclosure via brackets 60*a* and 60*b* (FIG. 6A) to a curb-side wall to the right of the workstation via bracket 60*c* (FIG. 6B) or to a road-side wall to the left of the workstation via bracket 60*b* (FIG. 6C). FIGS. 6A-6C also show shock isolation mount 62*a* and 62*b* for the base of frame 22.

Figure 7:
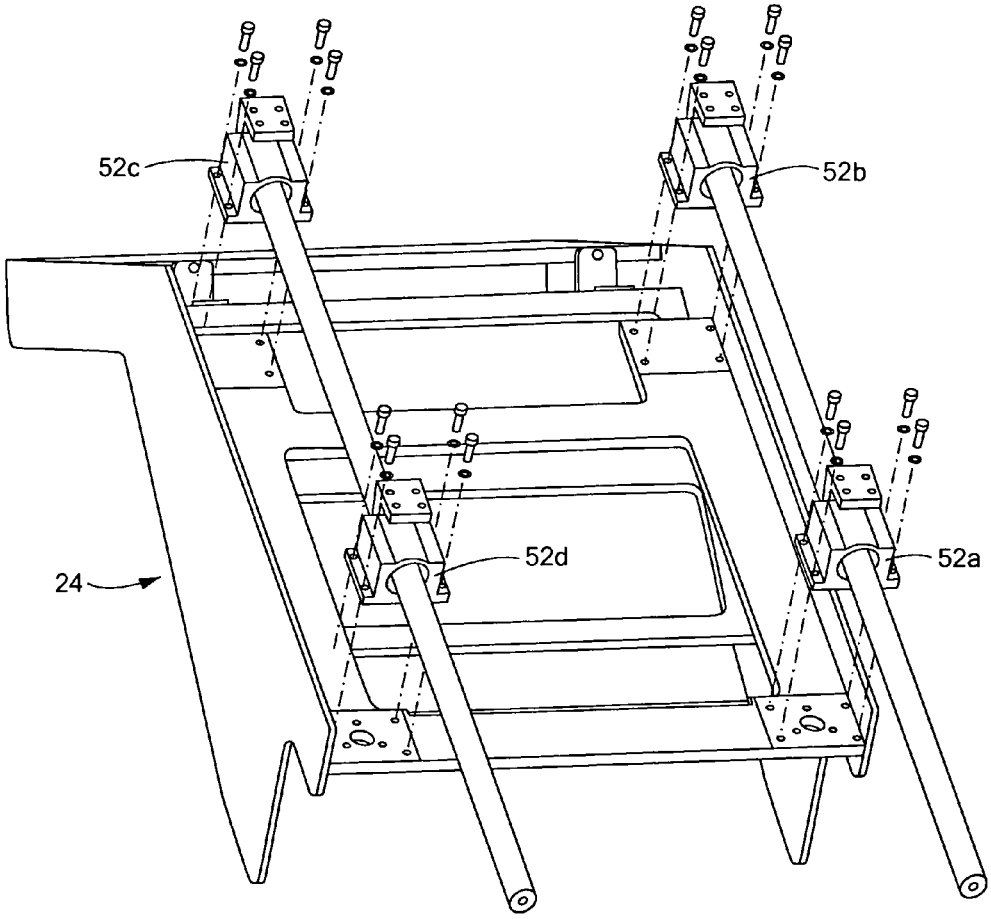
FIG. 7 is a schematic three-dimensional exploded rear view showing the console of the workstation, its friction bearings, and how they ride on the two rails mounted to the frame portion of the workstation (not shown in FIG. 7)
Figure 8:
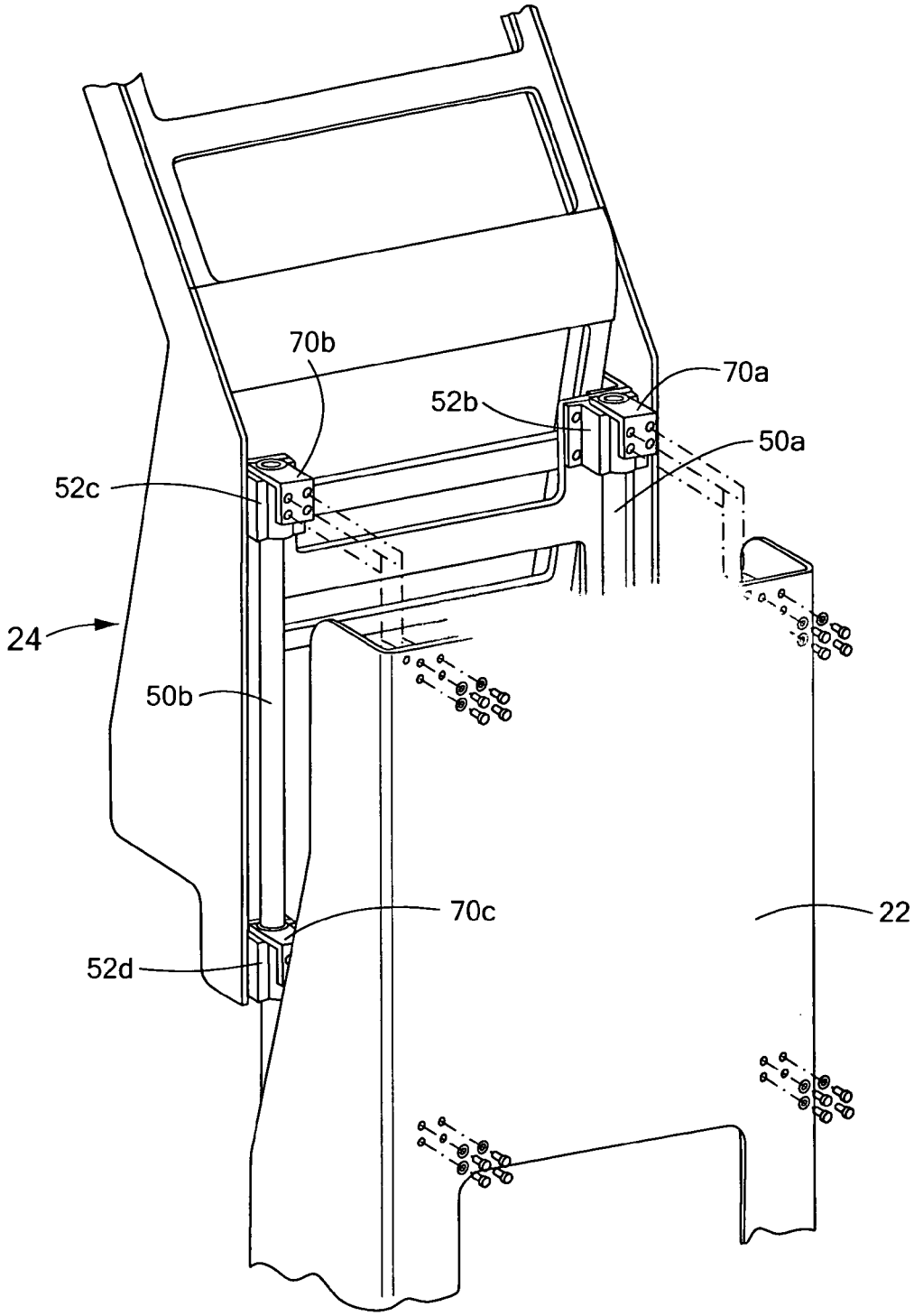
FIG. 8 is a schematic three-dimensional partial rear view showing how the rails of FIG. 7 mount to the frame portion of the workstation.

FIG. 7 shows friction bearings 52*a*-52*d* mountable to console 24 and movable on rails 50*a* and 50*b* mountable, as shown in FIG. 8, to frame 22 via brackets such as bracket 70*a*-70*c*.

Figure 9:
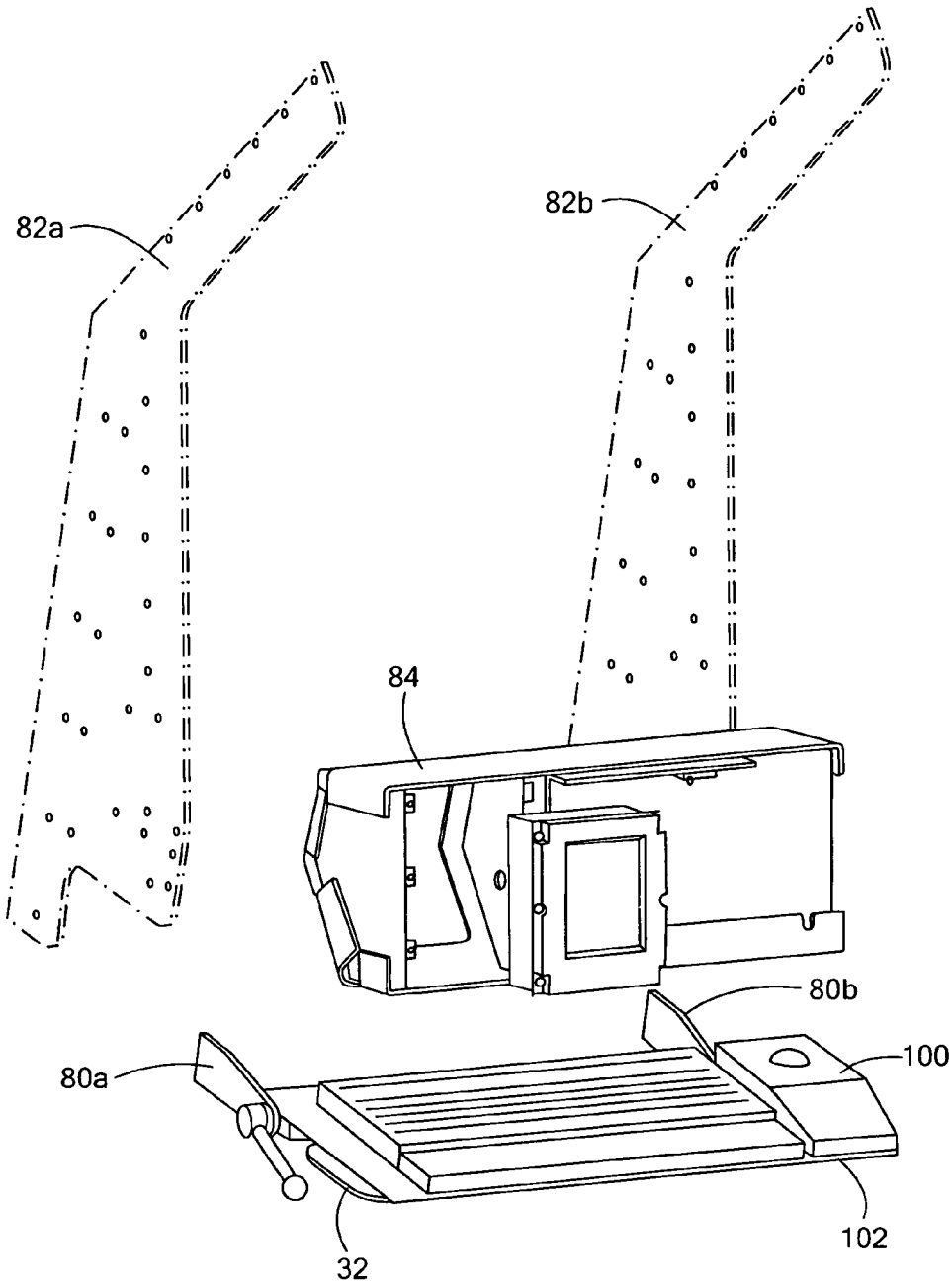
FIG. 9 is a schematic three-dimensional front view showing several of the primary components associated with the keyboard tray for a workstation in accordance with the subject invention.
Figure 10:
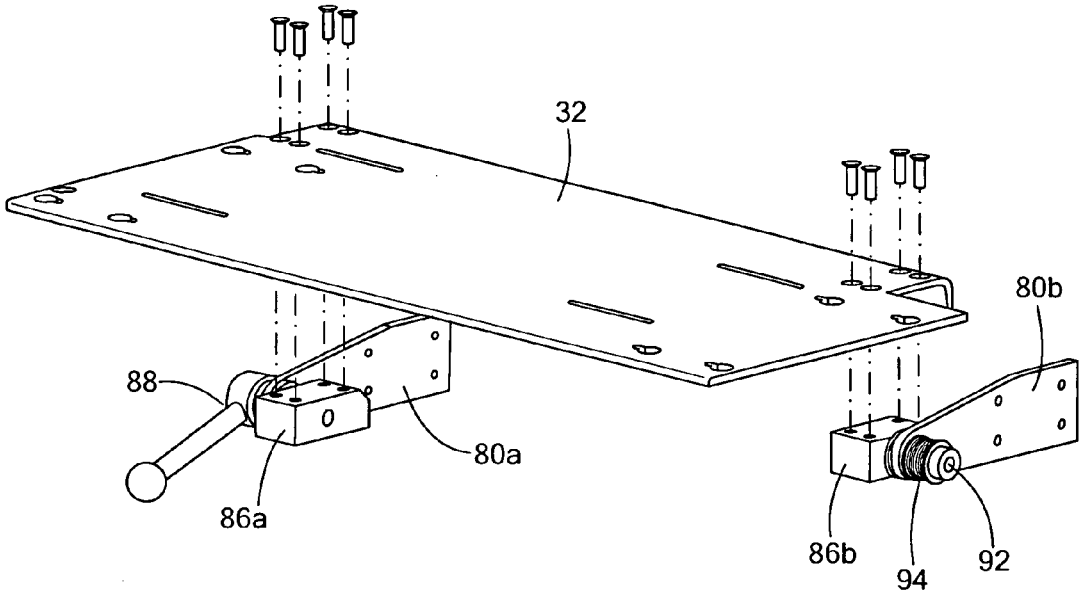
FIG. 10 is a schematic three-dimensional partially exploded view again showing several of the primary components associated with the keyboard tray of the subject invention.
Figure 11:
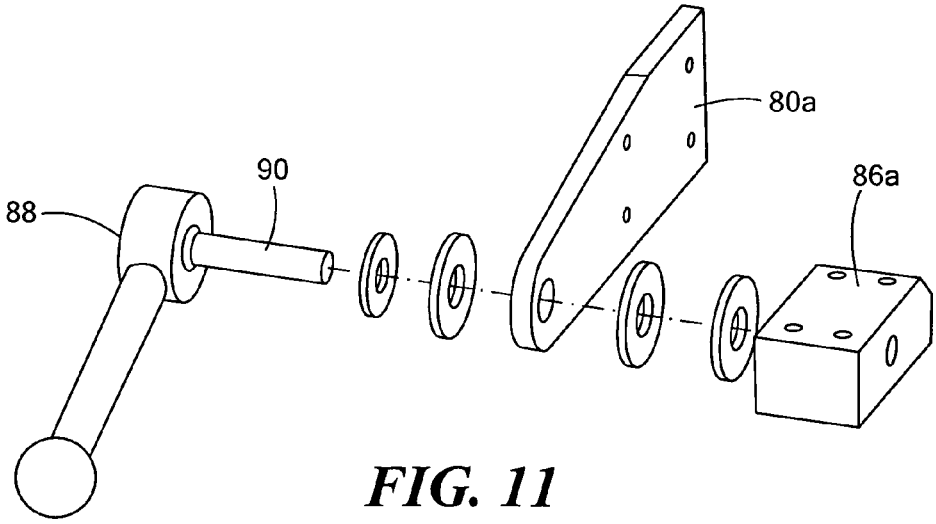
FIG. 11 is a schematic three-dimensional exploded view showing an adjustable handle assembly for the keyboard tray shown in FIG. 10.

FIG. 9 shows in greater detail one preferred example of keyboard tray 32 with an adjustable friction hinge assembly between tray 32 and the console of the workstation. Ears 80*a* and 80*b* mount to sidewalls 82*a* and 82*b* of the console. FIG. 9 also shows housing 84 mountable between sidewalls 82*a* and 82*b*. FIG. 10 shows brackets 86*a* and 86*b* both mountable to tray 32. Handle 88, FIGS. 10 and 11, includes shaft 90 which extends through ear 80*a* and into bracket 86*a*. FIG. 12 shows fastener 92 which extends through belleville washer set 94, through ear 80*b*, and into bracket 86*b*.

In such a design, when handle 88, FIG. 10 is turned one way, tray 32 can be tilted but it does not fall down due to the constant friction provided by belleville washers 94. When handle 88 is turned the opposite way, it positively clamps ear 80*a* between handle 88 and bracket 86*a*. Again, one idea is, to the maximum extent possible, one handed operation of the workstation and its components. The constant friction force on tray 32 can be changed by changing the number of belleville washers shown in FIG. 12. And, depending on the clearance available on the left and/or right side of tray 32, handle 88 can be moved for a curbside or roadside mount as shown in FIG. 13.

The result in any embodiment is a novel height adjustable workstation. The workstation can preferably accommodate dual touch panel displays and is adjustable to accommodate $5^{th}$ through $95^{th}$ percentile operators. The modular workstation is quickly and easily deployed and also quickly and easily stowed. It preferably has a small footprint and is rugged in design and also provides shock isolation. Preferably, the force to drive the console down with respect to the frame is less than 5 pounds. One-handed operation of all the movable components of the workstation is preferred. Although the workstation described herein is shown in the environment of a height reducible electronics enclosure, the workstation of the subject invention is not limited to such a use. The workstation design hereof could be integrated and implemented in any tactical electronics enclosure where an ergonomic, quickly deployable, height adjustable workstation is required. Other attributes include a modular design, and a small footprint. Other potential applications include commercial and industrial workstation structures where a stand-alone adjustable console is required. The workstation provides height adjustability features with multiple operator height as well as a stowed position as discussed above. The console is preferably controlled by a passive lift assist mechanism utilizing constant force springs and linear slides. The adjustable keyboard tray is held in place by friction and one hinge is operator adjustable. The other hinge maintains a constant minimum friction drag over wide operating conditions and life. Two 21-inch displays, processors, and controls are packaged in a C-130 compatible and MIL-STD-1472 human factors compliant solution. The workstation is also designed to meet the MIL-STD-810 ground mobile transportation environment. An integrated crew access unit and storage compartment is also featured as is a pointing device 100 tray 102.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A height adjustable workstation comprising:

a stationary frame comprising a pair of side members, a console supported by said frame between said side members and movable up and down with respect to the frame between a deployed position and a stowed position; and a keyboard tray pivotally connected to the console and pivotable with respect thereto between a substantially horizontal position and a stowed position; wherein the keyboard tray is in the substantially horizontal position when the console is in the deployed position, and is pivoted upwardly to the stowed position when the console is in the stowed position.

2. The workstation of claim 1 in which the console includes a first monitor rack and a second monitor rack angled outwardly over the first monitor rack.

3. The workstation of claim 1 further including at least one spring mounted to the frame and secured to the console and biased to drive the console up.

4. The workstation of claim 3 in which said spring is a constant force spring.

5. The workstation of claim 1 in which the frame includes two spaced rails and the console includes bearings which ride on the rails.

6. The workstation of claim 1 further including a latch for releasably locking the console in the stowed position.

7. The workstation of claim 1 further including an adjustable friction hinge assembly between the keyboard tray and the console.

8. The workstation of claim 7 in which the adjustable friction hinge assembly includes a first ear coupled to one side of the console, a first bracket coupled to one side of the tray, and a handle with a shaft extending through the first ear and into the first bracket.

9. The workstation of claim 8 in which the adjustable friction hinge assembly further includes a second ear coupled to an opposite side of the console, a second bracket coupled to an opposite side of the tray, a set of belleville washers, and a fastener extending through the belleville washers and the second ear and into the second bracket.

10. A height adjustable workstation comprising:

a stationary frame comprising a pair of side members, said frame including spaced rails;

a console supported by said frame between said side members, and including friction bearings which ride on the rails for moving the console up into a deployed position and down to a stowed position with respect to the frame;

a keyboard tray supported by the console and pivotable with respect thereto/between a substantially horizontal position and a stowed position; wherein the keyboard tray is in the substantially horizontal position when the console is in the deployed position, and is pivoted upwardly to the stowed position when the console is in the stowed position; and spring means for biasing the console into the deployed position.

11. The workstation of claim 10 in which the console, when fitted with one or more monitors, has a weight and the biasing force of the spring means is approximately equal to the weight and the friction force of the friction bearings.

12. The workstation of claim 11 in which the spring means includes a pair of constant force springs mounted to the frame and secured to the console.

13. The workstation of claim 10 further including an adjustable friction hinge assembly between the keyboard tray and the console.

14. The workstation of claim 13 in which the adjustable friction hinge assembly includes a first ear coupled to one side of the console, a first bracket coupled to one side of the tray, and a handle with a shaft extending through the first ear and into the first bracket.

15. The workstation of claim 14 in which the adjustable friction hinge assembly further includes a second ear coupled to an opposite side of the console, a second bracket coupled to an opposite side of the tray, a set of belleville washers, and a fastener extending through the belleville washers and the first ear and into the second bracket.

* * * * *